United States Patent [19]

Merkle

[11] 4,066,856

[45] Jan. 3, 1978

[54] LOCK FOR SAFETY CUT-OUT SWITCH

[76] Inventor: Paul Merkle, Eschenbrunnlestr. 48, 7032 Sindelfingen, Germany

[21] Appl. No.: 585,750

[22] Filed: June 11, 1975

[30] Foreign Application Priority Data

June 12, 1974 Germany ..... 2428454

[51] Int. Cl.[2] ..... H01H 9/28

[52] U.S. Cl. ..... 200/44

[58] Field of Search ..... 200/42 R, 42 T, 44

[56] References Cited

U.S. PATENT DOCUMENTS

| | | | |
|---|---|---|---|
| 1,789,462 | 1/1931 | Douglas | 200/44 |
| 1,826,509 | 10/1931 | Douglas | 200/44 |

*Primary Examiner*—Herman J. Hohauser

[57] ABSTRACT

A bellcrank lever has a locking cut-out with an oblique edge towards the end of one leg and a second leg which engages a notch in a switch. A blocking lever has a blocking lug at its free end which engages the locking cut-out. Insertion of the key swivels the blocking lever clockwise and swivels the bellcrank lever counter-clockwise out of engagement with the switch notch. Withdrawing of the key causes the levers to swivel in the opposite directions. The blocking lug then engages an extension in the locking cut-out and blocks the counter-clockwise swivel of the bellcrank.

If the leg of the bellcrank lever cannot re-engage the switch notch, the oblique edge of the cut-out blocks the clockwise swivel of the blocking lever and the key connot be withdrawn.

3 Claims, 5 Drawing Figures

LOCK FOR SAFETY CUT-OUT SWITCH

The subject matter of the invention is a single-key lock for a safety cut-out switch (for electrical lines) without a longitudinally slidable lock insert or slide member and without a special intermediate lever for bridging a sufficient distance between the key and the switch toggle disk. According to the invention this is achieved by using for this lock an extremely large bellcrank lever as switch blocking lever which is loaded by a spring tending to swivel the lever into its blocked position and which, on the other hand, is locked by a transverse lug of a horizontally arranged lever which is controlled via a roller by the lower edge of the key, said transverse lug engaging in a cutout extension and thus blocking the anti-clockwise swivelling movement of said lever.

The exploitation of this principle, which depends on the fact that the key must not be withdrawable without a simultaneous clockwise swivelling movement of the switch blocking lever, is made possible with this lock by providing the blocking cutout of the switch blocking lever with a corresponding oblique control edge by which the switch blocking lever is positively swivelled clockwise when the key is being withdrawn. The lock blocking lever is also loaded by a spring tending to swivel it in the anticlockwise direction. The spring must be so strong that the force of the tension spring of the switch blocking lever will not release the key from its arrested position in which it is engaged by the lock blocking lever. In this lock the control movement of the key is more than doubled in accordance with the leverage ratio $a/b$ and thus a relatively large locking movement of the blocking lug is achieved. In accordance with the preceding part of this specification the spring of the switch blocking lever must be designed as weak as possible.

Figure 1:
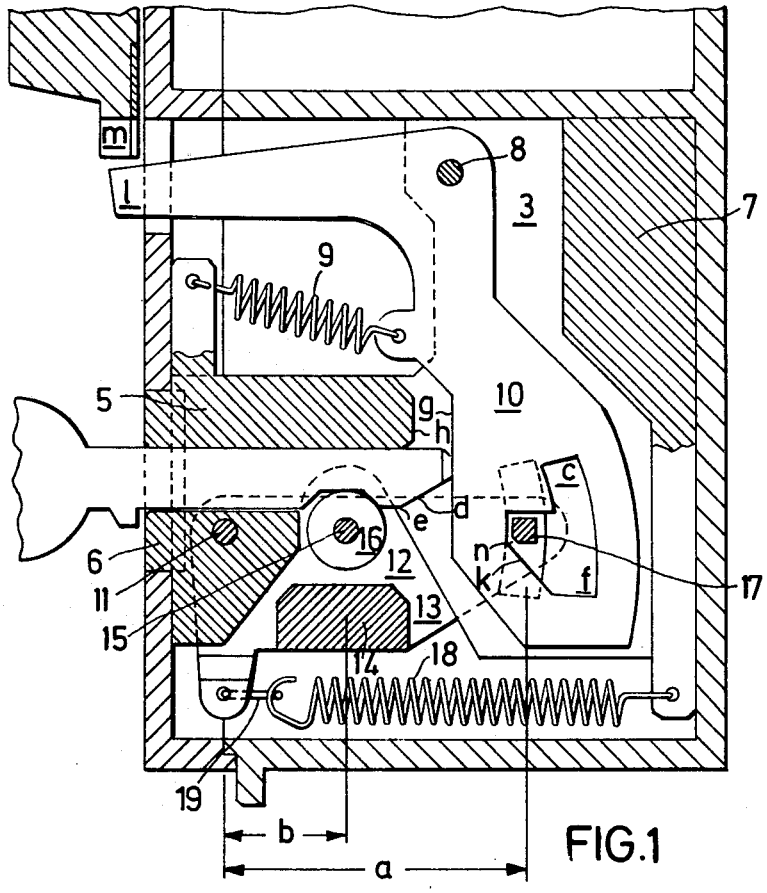
Figure 2:
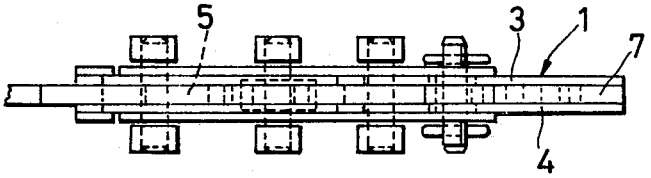
Figure 3:
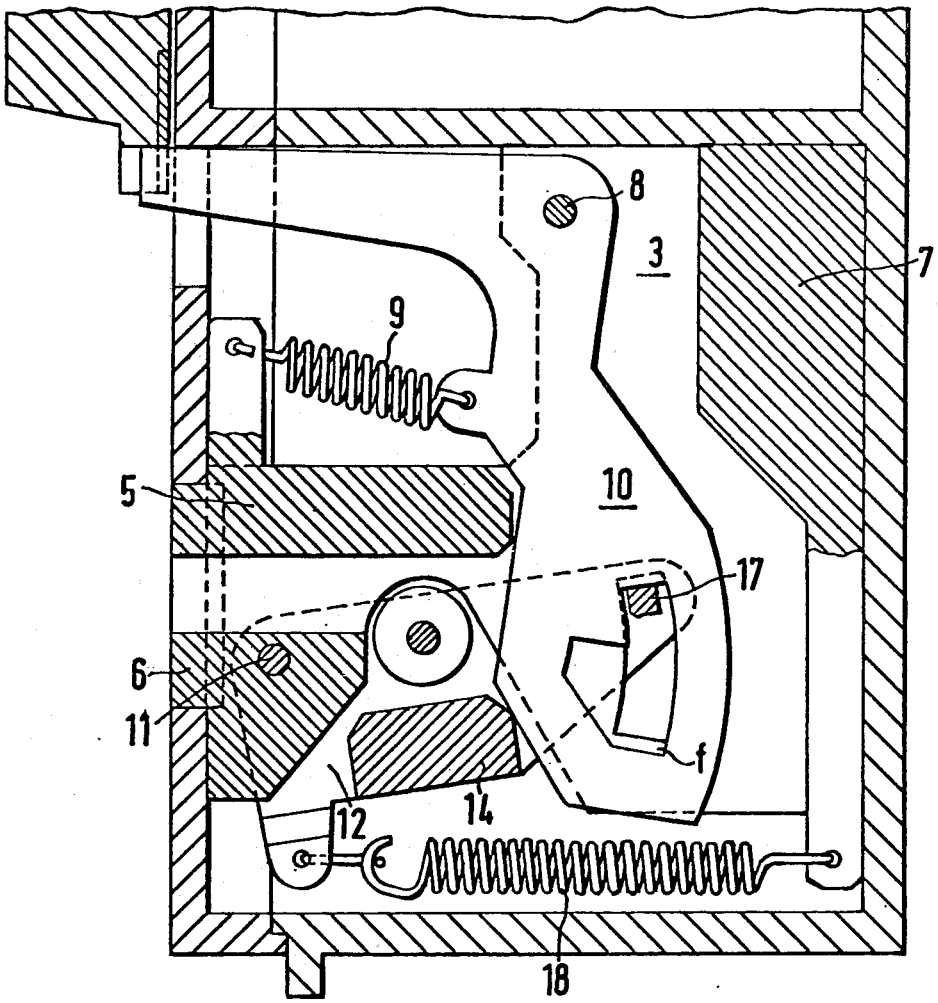
Figure 4:
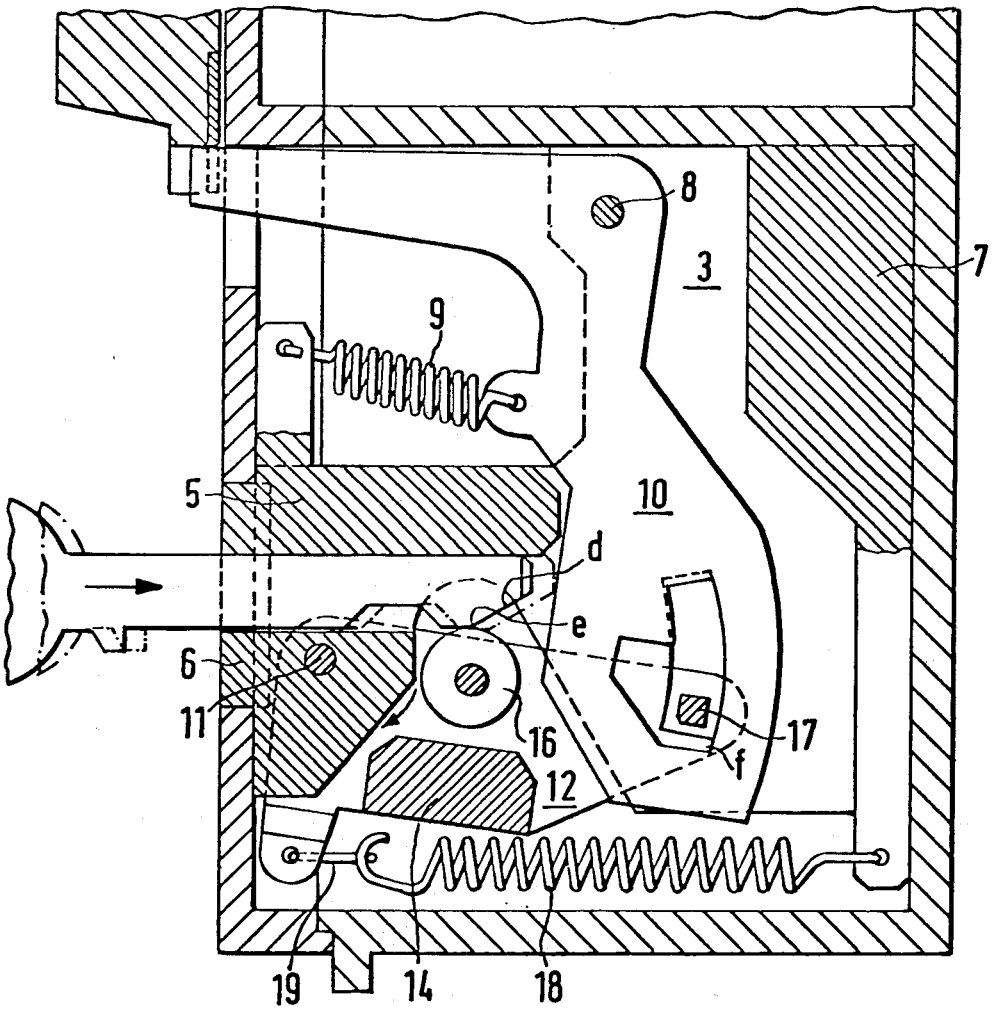
Figure 5:
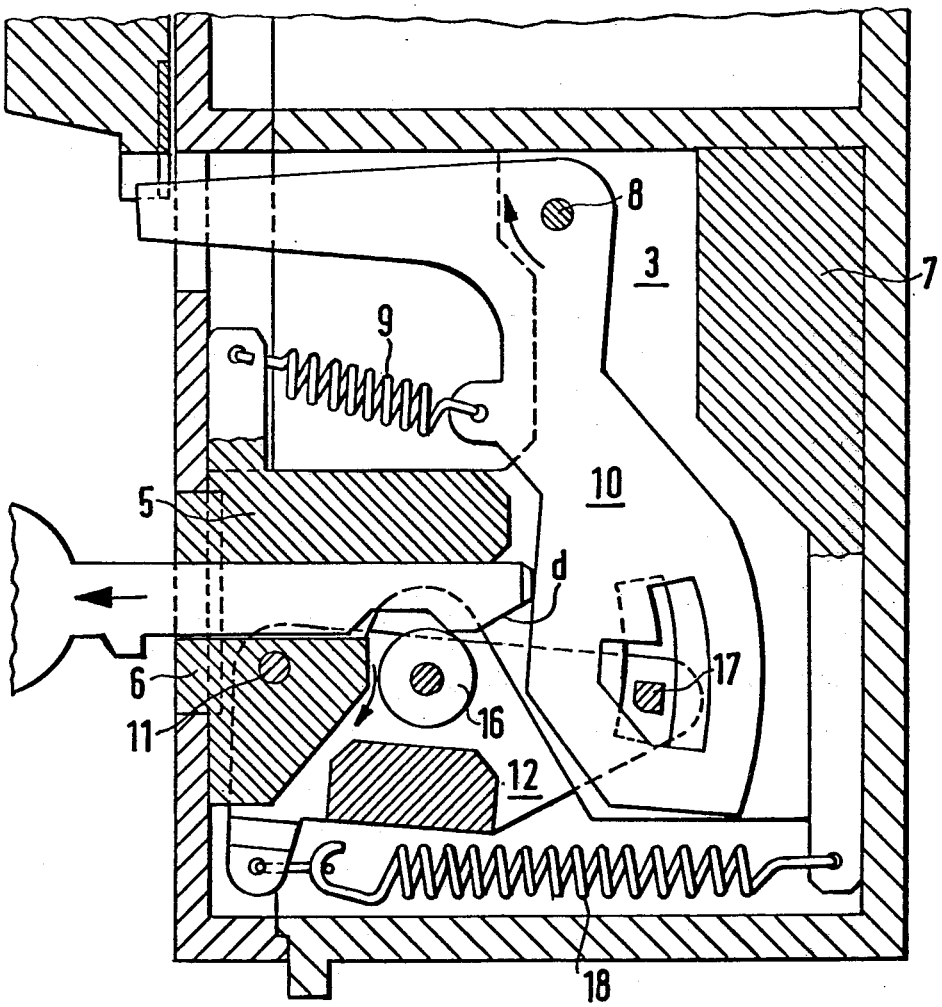

The lock is represented in FIGS. 1–5. FIG. 1 shows the vertical longitudinal section through the lock and the lower portion of the switch housing, the key, the switch blocking lever and the roller of the lock blocking lever being represented integrally. FIG. 2 is a plan view of the lock without switch housing. FIGS. 3–5 (together with FIG. 1) show the arrangement of FIG. 1 in successive stages of operation as hereinafter described.

Referring to the Figures the switch for which the lock according to the invention is used is of a known type, comprising a rotatable knob 21 on a rotatable shaft (not shown). The arrangement of the switch contacts and their special embodiments are not of any importance with regard to the invention. It is only necessary, that in the off position the switch contacts are open and that in one or more on-positions the switch contacts are closed. An example of such a switch known in the art is shown in the copending applicaton Ser. No. 585,748, filed June 11, 1975. FIG. 3 shows the bellcrank engaging the switch and hence locking the switch in the off position.

On the one hand, the lock consists of the lock housing 1 which is composed of the side plates 3 and 4 and the intermediate pieces 5 through 7 and, on the other hand, of moving parts such as the switch blocking lever 10 which pivots about the bolt 8 and is loaded by the tension spring 9 as well as the lock blocking lever 12 which is arranged to swivel about bolt 11 and which is composed of two side plates 13, connecting piece 14, bearing bolt 15, roller 16 and blocking lug 17 and which pivots about bolt 11. Part 18 is the tension spring of the lock blocking lever and part 19 an intermediate hook arranged for the protection of the spring 18. The lock housing side plates 3 and 4 are riveted together through the intermediate pieces 5 through 7 or welded together by means of a resistance spot welded joint. The bearing bolts are secured by forced on bushings or other means so that they cannot drop out. Only in this switched off position, the knob 21 may be locked by the switch locking member 10 which is cooperating with the lock blocking lever 12 by means of blocking lug 17 engaging with a cut out portion 22 of the switch blocking lever 10. The switch blocking lever 10 is located inside the lockhousing, which as stated, is formed of two parallel metal plates 3 and 4 shown in FIG. 2. The lock blocking lever 12 which, as stated, is formed by two flat and parallel sideplates 13 is arranged outside the lockcasing 1 and adjacent to the casing plates 3 and 4. Thus, as stated, the casing 1 formed by the plates 3 and 4 is provided with cutouts for the bearing bolt 15 of the roller 16 which is a member of the lock blocking lever 12. The lock blocking lever 12 is pivotally secured to the lockhousing by means of bolt 11. The sideplates 3 and 4 are kept in the provided distance from one another by means of intermediate pieces 5, 6, and 7 which are secured to the housing 23. The verticle dashed lines of FIG. 2 designate only the position of the various edges of these intermediate pieces 5 to 7 in the plan view of the lock without switch-housing.

The mode of action of the lock is as follows: referring to FIG. 3, before the introduction of the key the switch blocking lever 10 is in its clockwise swivel end position in which the switch toggle disk is locked and the lock blocking lever 12 in its anti-clockwise swivel end position in which the blocking lug 17 is engaged in the cutout extension c of the switch blocking lever 10 and the switch blocking lever, in turn, is locked. Subsequently, referring to FIG. 4, when the key is (further) introduced its edge d first comes into contact with roller 16 which, upon further introduction of the key, causes the lock blocking lever 12 to be swivelled about its bearing bolt 11 in the clockwise direction.

This clockwise swivel motion of the lock blocking lever 12 is terminated when point e of the key is contacting the upper apex of roller 16; in this position the blocking lug 17 is in corner f of the switch blocking lever cutout. Then referring to FIG. 1, the key tip comes into contact with edge g of the switch blocking lever 10, whereby the latter is swivelled about its bearing bolt 8 in the anti-clockwise direction into its unlocked position as the key is further introduced, the lock blocking lever 12 simultaneously performing an anticlockwise motion as the roller 16 snaps into the key notch. Thus, the position of the lock represented in the drawing is attained in which the forward end l of the switch blocking lever 10 has left the notch m in the switch toggle disk and the switch can be switched on.

Referring to FIG. 5, locking of the switch, which is only possible in its switched off position, is then effected by withdrawing the key again. This results in a positive clockwise swivel motion of the switch blocking lever which actually is not necessary because of the tension spring 9 but which is due to the fact that said lever is displaced in a clockwise swivel motion through its oblique edge $k$ by blocking lug 17, whereby the key withdrawal blocking effect, with the switch being not switched off, is achieved. The clockwise swivel motion of the switch blocking lever 10, during which its forward end l is again entering the notch *m* of the switch toggle disk, is then terminated when the lever edge g is bearing against edge h of the intermediate piece 5. Then referring again to FIG. 3 follows the further outward movement of the key during which roller 16 rolls off on edge d of the key in the reverse direction, whereby the lock blocking lever 12 performs an anti-clockwise swivel movement and, after having passed the horizontal position, its blocking lug 17 engages in the cutout extension c of the switch blocking lever 10 in which the latter, in turn, is locked. Thus, the switch toggle disk as well as the switch blocking lever are again locked.

In a second embodiment, one moving part consists of a bellcrank lever the vertical leg of which is composed of two side plates (i.e. a double layer design) connected with the blocking lug. Another moving part consists of a blocking lever which is moved by the lower edge of the key through a tongue and has a rear correspondingly large end provided with the blocking cut-out.

The embodiments described are flat pin plug-type locks.

What is claimed is:

1. A safety cut-out switch for electrical lines, comprising a switch actuation knob having at its base a switch toggle disk integral therewith, said disk having a notch at its lower periphery a switch blocking bell crank lever having a downwardly arranged leg with a cut-out therein and a horizontally arranged leg with a forward end portion pivotable between an upper and lower position, which engages said notch in the upper position to block said switch said horizontally arranged leg being adapted to be pivoted in a vertical plane which is perpendicular to said switch toggle disk, a lock blocking means to block said bell crank lever in an upper switch b locking position, and an unlocking means to remove said bell crank lever from its switch b locking position, said lock blocking means and said unlocking means being actuated by horizontal in-and outward movement of a key and adapted to cooperate with said downwardly arranged leg of said switch blocking bellcrank lever, a first tension spring for holding said bell crank lever in its upper switch blocking position, and acting on said lever in a first direction of rotation, said lock blocking means and said unlocking means comprising a lock blocking lever having a roller pivotably secured thereon and adapted to be pivoted in the same plane as said switch blocking lever and being loaded in a second and opposite direction of rotation, by means of a second tension spring, thereby keeping said roller in close abutment to the lower edge of an in-and outwardly movable key, an in-and outwardly movable key provided with a notch into which said roller snaps and locks said key in its innermost position, in which the tip of said key holds said bellcrank blocking lever in its unlocking position against the tension of said first tension spring, said lock blocking lever further being provided with a transverse lug, engaging said cut-out in said downwardly arranged leg, said cut-out having an oblique edge along which said lug moves during the pivoting downward motion of said lock blocking lever as said key is withdrawn, and against which said lug is abutting and thereby preventing said key from being fully withdrawn when said switch toggle disk is not in position to be blocked by said bell crank lever.

2. A safety cut-out switch according to claim 1, in which said lock blocking lever is composed of two side plates, the cut-out bearing end portion of the downwardly arranged leg engaging therebetween.

3. A safety cut-out lock according to claim 1 in which said cut-out has an extension and locking of said bellcrank lever is effected by withdrawing said key, thereby pivoting said lock blocking lever to its extreme position in said first direction of rotation and thereafter into its extreme position in said second and opposite direction of rotation in which said blocking lug is engaged in said cut-out extension.

* * * * *